US005864274A

United States Patent [19]

Steingroever et al.

[11] Patent Number: 5,864,274

[45] Date of Patent: Jan. 26, 1999

[54] MAGNETO-MECHANICAL POWER SYSTEM

[75] Inventors: Dietrich Steingroever, Bergisch Gladbach; Erich Steingroever, Bonn, both of Germany

[73] Assignee: Magnet-Physik Dr. Steingroever GmbH, Germany

[21] Appl. No.: 64,725

[22] Filed: Apr. 23, 1998

[30] Foreign Application Priority Data

May 27, 1997 [DE] Germany ..... 197 22 013.4

[51] Int. Cl.[6] ..... H01F 7/08

[52] U.S. Cl. ..... 335/234; 335/226

[58] Field of Search ..... 335/229–234, 335/177, 179, 226, 245

[56] References Cited

U.S. PATENT DOCUMENTS 5,010,911 4/1991 Grant ..... 137/68.1

5,268,662 12/1993 Uetsuhara et al. ..... 335/229

FOREIGN PATENT DOCUMENTS 1 022 712 1/1958 Germany .

*Primary Examiner*—Lincoln Donovan
*Assistant Examiner*—Raymond Barrera
*Attorney, Agent, or Firm*—Harold Gell

[57] ABSTRACT

A magneto-mechanical power system including a cylindrical soft-iron vessel with permanent magnets arranged to form a shunt-magnetic gap with the inside wall the soft-iron vessel. The neck of the flux conducting disk is surrounded by a current winding. A magnetically attractable pole disk lies on the neck of the soft-iron vessel. An electrically conducting ring is fastened to the pole disk. The pole disk activates mechanical and/or electrical safety devices. The system is activated by a current impulse sent to the current winding. Current in the current winding creates a field that displaces the magnetic flux path of the permanent magnet.

14 Claims, 1 Drawing Sheet

FIG.1
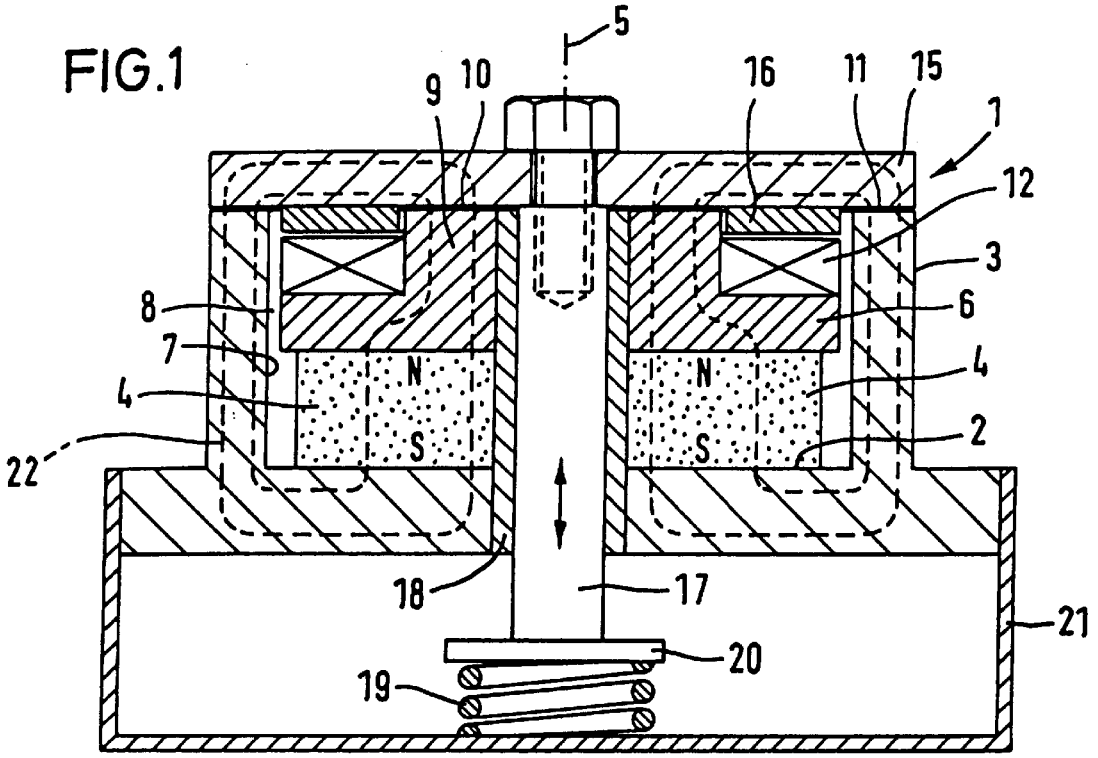
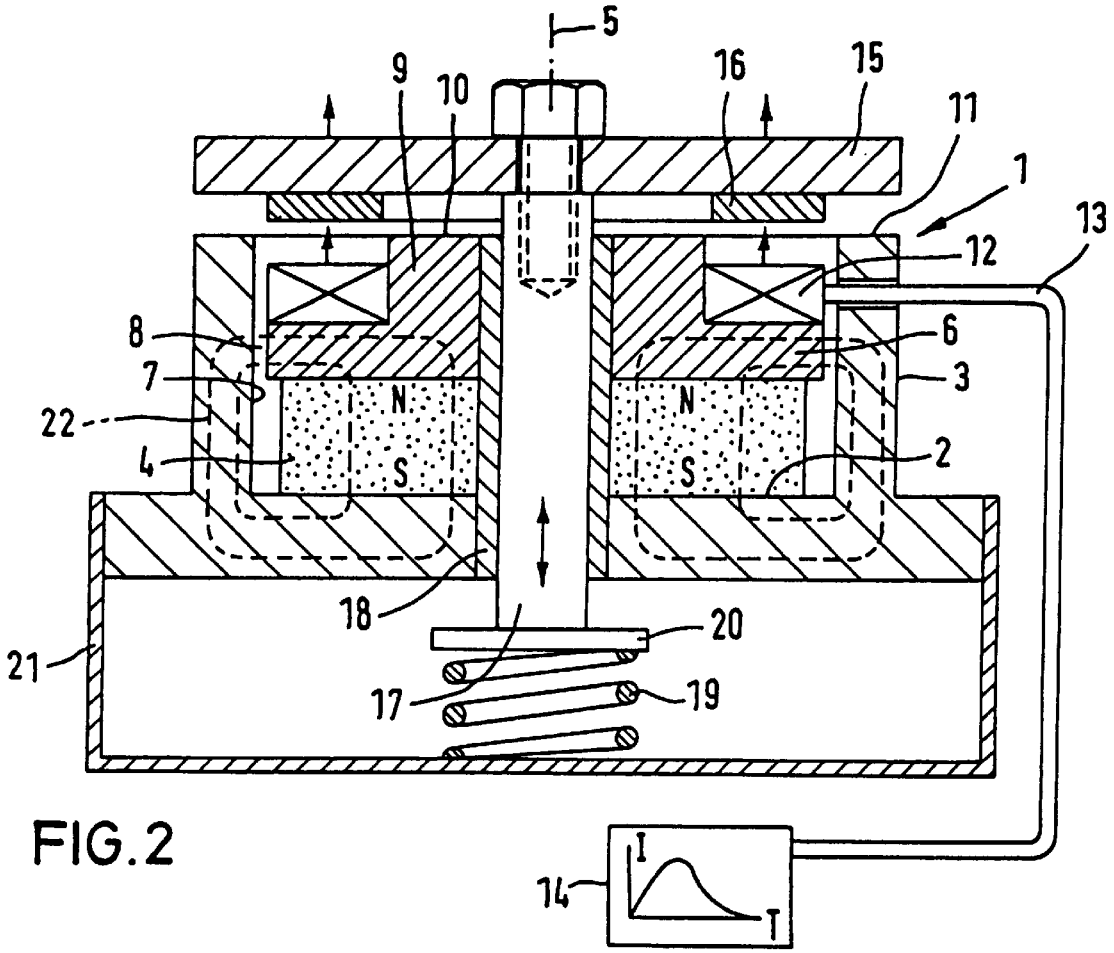
FIG.2

MAGNETO-MECHANICAL POWER SYSTEM

FIELD OF THE INVENTION

The invention relates to a magneto-mechanical power system particularly suited for fast operation of mechanical and/or electrical equipment in response to a current impulse.

BACKGROUND OF THE INVENTION

The known German Patent DE 10 22 712 C1 discloses a clamping magnet for an electric circuit breaker system with clamping power in the axial direction provided by a permanent magnet magnetized by means of an electric circuit winding to shift a ring-shaped magnetic flux path from the work air gap to a shunt-magnetic gap. Systems as described in the above cited patent are slow acting with a power and activation curve that follows the applied current pulse.

SUMMARY OF THE INVENTION

The clamping magnet system has a ring-shaped permanent magnet with North and South magnetic poles, a first pole disk with a cylindrical bore is located at one end of the permanent magnet and a second pole disk and pole body is located at the other end of the permanent magnet and centered within the bore of the first pole disk for creating the working magnetic gap. The first pole disk is formed as a soft iron vessel, the floor and inner wall of which forms a shunt-magnetic gap with the other pole disk. In the deenergized condition, a magnetic flux path traverses the pole body and crosses the working magnetic gap; when energized, an electric circuit winding diverts the magnetic flux path over the inside wall of the soft-iron vessel and across the shunt-magnetic gap to the second pole disk so that the working magnetic gap becomes unmagnetic and releases the adhering parts.

OBJECTIVES OF THE INVENTION

The underlying purpose of the invention is to improve the previously known status of the technology of magneto-mechanical power systems, to make such a system from a few robust but simple parts that is particularly fast acting for operating mechanical and/or electric equipment, also for the fast reaction by electric safety switches in response to a current impulse.

This task finds its solution in the magneto-mechanical power system of the present invention through the following features:

1.1 one or several permanent magnets located at the inside bottom surface a cylindrical soft-iron vessel, 1.2 the permanent magnet or array of permanent magnets support a flux conducting disk which forms a shunt magnetic gap with the inside wall the soft-iron vessel, 1.3 the flux conducting disk is stepped down to form a neck of smaller diameter with an upper edge in a common plane with the edge the soft-iron vessel, 1.4 the neck of the flux conducting disk is surrounded by a current winding, 1.5 a magnetically attractable pole disk lies on the top of the neck of the flux conducting disk and on the edge the soft-iron vessel, 1.6 a ring fabricated from electrically conducting material, such as copper, aluminum or similar conductors, is fastened to the side of the pole disk, 1.7 the pole disk itself or a piston fastened to it serves to activate connected equipment, 1.8 the current coil is connected to a current source.

The invention has an advantage in that such a magneto-mechanical power system can be assembled in an especially simple way from a few, simple to process work pieces.

A ring-shaped permanent magnet or a plurality of permanent magnets proportionately distributed through a ring-shaped cage fabricated from insulating material are positioned on the inside bottom surface of the soft-iron vessel.

A flux conducting disk is inserted in the soft-iron vessel so that it lies on the ring-shaped permanent magnet or the ring-shaped array of permanent magnets and can form a shunt-magnetic gap with the inside wall the soft-iron vessel which also receives a current winding connected by a cable to a current source.

A magnetically attractable pole disk is set on the top of the neck of the flux conducting disk and the top edge of the soft-iron vessel. A ring fabricated from electrically conducting material, such as copper, aluminum or similar conductors, is fastened to the winding side of the pole disk. It is self short-circuited.

A piston is connected to the pole disk for activating connected equipment.

The piston fastened to the pole disk passes through a central cylindrical opening or bore hole in the flux conducting disk, the permanent magnet and the inside bottom surface of the soft-iron vessel.

A spring exerts moderate control over the pole disk or piston to hold the power system in the opened position and after each release, it is automatically forced back to the starting position.

The power system is activated when a current impulse is applied to the current winding. This may be provided by the discharge of a condenser connected to the current winding by a fast acting, high current-switch (Thyristor or such). It can achieve a switching time of under 1 ms.

The fast rising current in the current winding causes the magnetic flux path of the permanent magnet to be displaced through the shunt-magnetic gap and induces an opposing current in the short-circuit ring of the flux conducting disk, causing it to be repulsed by the current winding so that the pole disk with the short-circuited ring of copper, aluminum or similar conductors fastened thereto is removed from the neck of the flux conducting disk and the top edge of the soft-iron vessel and thereby operates connected equipment.

A monitoring circuit providing continuous readiness is provided by the operational readiness of the impulse-instrument.

Examples for further applications the magneto-mechanical power system are:

a) Actuation of production stamping machines, replacing hydraulic or pneumatic valves, b) To produce pressure or shock waves in a fluid, c) To actuate safety devices in motor vehicles in connection with a crash sensor.

DESCRIPTION OF THE DRAWINGS

Preferred examples of the invention are presented in the drawing which show:

FIG. 1 is a vertical sectional view of a magneto-mechanical power system at rest and FIG. 2 illustrates the power system after release by a pulse of electrical current.

DETAILED DESCRIPTION

The magneto-mechanical power system 1 is particularly suited for the sudden activation of mechanical and/or electric safety devices in response to a current impulse.

As can be recognized in the drawing, one or several permanent magnets 4 are arranged on the inside bottom surface 2 of a cylindrical soft-iron vessel 3. Either a closed ring-shaped permanent magnet 4 can be used or a multitude of permanent magnets 4 may be held around the longitudinal axis 5 the soft-iron vessel 3 by a ring-shaped cage fabricated from insulating material.

The permanent magnet 4 supports a flux conducting disk 6 for forming a Shunt-magnetic gap 8 with the inside wall 7 of the soft-iron vessel 3.

The flux conducting disk 6 has, as shown in the drawing, a necked down section 9 of slightly smaller diameter the end 10 of which lies in a common plane with the edge 11 the soft-iron vessel 3.

The neck 9 of the flux conducting disk 6 is surrounded by a current coil 12 which is connected by a cable 13 (FIG. 2) to a current source 14.

A magnetically attractable pole disk 15 lies on the neck 9 of the flux conducting disk 6 and on the edge 11 the soft-iron vessel 3.

A ring 16 fabricated from electrically conducting material, such as copper, aluminum or similar conductors is fastened to the side of the pole disk 15. The pole disk 15 by its self or when fastened to a piston 17 serves to activate connected equipment such as a mechanical and/or electric safety device which is not presented in the drawing.

The piston 17 is fastened to the pole disk 15 and passes through a central cylindrical opening in the soft-iron vessel 3 and the magnet system therein via a guiding cylinder 18 which is fabricated from a non-magnetic material, such as brass, as is the piston 17. The guiding cylinder also serves as an axial guide for the pole disk 15. The soft-iron vessel 3, the permanent magnet 4 therein and the flux conducting disk 6 can be glued to the guiding cylinder 18 or joined thereto in another firm, expedient way so that all parts are centered in the soft-iron vessel 3.

The pole disk 15 or the piston 17 is controlled by a spring 19 which holds the piston 17 at its lower free end with a ring-shaped collar 20. The spring 19 is supported at the other end by the inside bottom surface of the casing vessel 21. The spring 19 is designed as pressure spring, so that the power system is held in the opened position at the end of each magnetic attraction, or as tension spring, so that the power system will be pulled back to its starting position. It can also be designed as a pressure spring between the collar 20 fastened to the piston 17 and the inside bottom surface 2 of the soft-iron vessel 3, so that it forces the piston 17 back to the starting position of FIG. 1 after each activation with the pole disk 15 put out. If necessary it can also provide support for the pole disk in opened position.

FIG. 1 shows the magnetic system in the deenergized condition with the pole disk 15 held on the outer edge 11 of the soft-iron vessel 3 by the magnetic force of the permanent magnet 4.

Turning on the current source 14 causes a fast rising current in the current winding 12 that displaces the magnetic flux path 22 of the permanent magnet. The current winding 12 forces the flux path of the permanent magnet 4 through the disk shaped ring of the flux conducting disk 6 and across the shunt-magnetic gap 8 so that the pole disk 15 supported on the neck 9 of the flux conducting disk 6 and top edge 11 the soft-iron vessel 3 is suddenly removed therefrom with the attached ring 16 of copper, aluminum or similar conductors and operates the connected equipment.

What is claimed is:

1. A magneto-mechanical power system activated by a current impulse for the sudden operation of mechanical and/or electric equipment, including the following features:

a permanent magnet (4) positioned at the inside bottom surface (2) of a cylindrical soft-iron vessel (3);

a flux conducting disk (6) positioned relative to said permanent magnet (4) for forming a shunt-magnetic gap with (8) an inside wall (7) of said soft-iron vessel (3);

said flux conducting disk (6) including a stepped down neck (9) of smaller diameter, an end (10) of which lies in a common plane with an edge (11) of said soft-iron vessel (3);

a current coil (12) surrounding said neck (9) of said flux conducting disk (6);

a magnetically attractable pole disk (15) positioned on said neck (9) of said flux conducting disk (6) and on said edge (11) of said soft-iron vessel (3);

a ring (16) fabricated from electrically conducting material selected from the group including copper, aluminum and similar non-magnetic conductors fastened to a side of said pole disk (15);

said pole disk (15) comprising means for activating connected equipment; and a current source (14) electrically connected to said current coil (12).

2. A magneto-mechanical power system activated by a current impulse for the sudden operation of mechanical and/or electric equipment as defined by claim 1, wherein, said pole disk (15) is controlled by a spring (19).

3. A magneto-mechanical power system activated by a current impulse for the sudden operation of mechanical and/or electric equipment as defined by claim 1, including the following features:

a piston (17) fastened to said pole disk (15) for activating connected equipment.

4. A magneto-mechanical power system activated by a current impulse for the sudden operation of mechanical and/or electric equipment as defined by claim 3, wherein, said piston (17) is controlled by a spring (19).

5. A magneto-mechanical power system activated by a current impulse for the sudden operation of mechanical and/or electric equipment as defined by claim 3, wherein, said piston (17) is fabricated from a non-magnetic material and passes through a central cylindrical opening in said soft-iron vessel (3) and said permanent magnet therein via a guiding cylinder (18) fabricated from a non-magnetic material which serves as the axial guide for said pole disk (15).

6. A magneto-mechanical power system activated by a current impulse for the sudden operation of mechanical and/or electric equipment as defined by claim 5, wherein, said non-magnetic material is brass.

7. A magneto-mechanical power system activated by a current impulse for the sudden operation of mechanical and/or electric equipment as defined by claim 5, wherein, said piston (17) is controlled by a spring (19).

8. A magneto-mechanical power system, comprising:

a cylindrical soft-iron vessel including an inside wall and open top forming an edge;

a permanent magnet positioned inside said cylindrical soft-iron vessel;

a flux conducting disk positioned relative to said permanent magnet for forming a shunt-magnetic gap with said inside wall;

a stepped down section of said flux conducting disk forming a neck smaller in diameter than said flux conducting disk with a top end in the same plane as said open top edge of said soft-iron vessel;

a current coil surrounding said stepped down section of said flux conducting disk;

a magnetically attractable pole disk positioned on said top end of said stepped down section of said flux conducting disk and on said open top edge of said soft-iron vessel;

a ring fabricated from electrically conducting, non-magnetic conductors fastened to said pole disk; and a current source (14) electrically connected to said current coil (12).

9. A magneto-mechanical power system as defined by claim 8, including:

a piston fastened to said pole disk for activating connected equipment.

10. A magneto-mechanical power system as defined by claim 9, wherein, said pole disk is controlled by a spring.

11. A magneto-mechanical power as defined by claim 9, wherein, said piston is controlled by a spring.

12. A magneto-mechanical power system as defined by claim 9, wherein, said piston is fabricated from a non-magnetic material and passes through a central cylindrical opening in said soft-iron vessel and said permanent magnet therein via a guiding cylinder fabricated from a non-magnetic material.

13. A magneto-mechanical power system as defined by claim 12, wherein, said non-magnetic material is brass.

14. A magneto-mechanical power system as defined by claim 12, wherein, said piston is controlled by a spring.

* * * * *